United States Patent [19]

Whiteside

[11] Patent Number: 4,495,209

[45] Date of Patent: Jan. 22, 1985

[54] METHOD OF FORMING, FILLING AND HERMETICALLY SEALING CONTAINERS

[76] Inventor: Michael G. Whiteside, 10 Relmar Rd., Apt. 1, Toronto, Ontario, Canada

[21] Appl. No.: 562,542

[22] Filed: Dec. 19, 1983

Related U.S. Application Data

[63] Continuation-in-part of Ser. No. 385,430, Jun. 7, 1982, abandoned.

[51] Int. Cl.[3] ..... B65B 7/20; B65B 7/28

[52] U.S. Cl. ..... 426/392; 53/471; 53/485; 53/489; 53/491; 53/458; 53/243; 229/5.5; 229/37 R; 229/43; 215/2; 426/106; 426/397

[58] Field of Search ..... 229/5.5, 37 R, 43; 426/392, 397, 106; 53/242, 243, 456, 458, 471, 491, 489, 485; 215/2

[56] References Cited

U.S. PATENT DOCUMENTS

| | | | |
|---|---|---|---|
| Re. 28,658 | 12/1975 | MacDaniel | 229/5.5 |
| 649,273 | 5/1900 | Craw | 229/43 |
| 1,129,199 | 2/1915 | Jewell | 53/491 |
| 2,097,647 | 11/1937 | Scott | 229/37 R |
| 2,138,699 | 11/1938 | Hinze | 229/5.5 |
| 2,251,283 | 8/1941 | Johnson | 229/37 R |
| 2,335,202 | 11/1943 | Wilcox | 229/5.5 |
| 2,390,909 | 12/1945 | Zinn | 229/37 R |
| 2,398,404 | 4/1946 | Brooks | 229/5.5 |
| 2,411,622 | 11/1946 | Guyer et al. | 229/37 R |
| 2,437,114 | 3/1948 | Moore | 229/43 |
| 2,562,579 | 7/1951 | Ringler | 229/5.5 |
| 2,887,933 | 5/1959 | Bergstein | 53/491 |
| 3,317,109 | 5/1967 | Palmer | 229/5.5 |
| 3,485,008 | 12/1969 | Silver | 53/491 |
| 3,583,596 | 6/1971 | Brewer | 229/43 |
| 3,756,493 | 9/1973 | Holmes | 229/5.5 |
| 3,831,342 | 8/1974 | Rejsa | 53/491 |
| 3,899,117 | 8/1975 | Peyser et al. | 229/5.5 |
| 3,967,773 | 7/1976 | Kaufmann | 229/5.5 |
| 4,019,674 | 4/1977 | Ikelheimer et al. | 229/5.5 |
| 4,183,457 | 1/1980 | Loughley et al. | 229/5.5 |

*Primary Examiner*—Steven Weinstein

*Attorney, Agent, or Firm*—Robert F. Delbridge; Arne I. Fors

[57] ABSTRACT

A method of forming, filling and hermetically sealing a container in which a thermoplastic lid is hermetically sealed to a paperboard container body while the container body is in an upside down orientation, with the container then being filled through the opposite upper end while the container is still in the upside down orientation, and with the filled container then being closed by means of flaps at the opposite end.

2 Claims, 11 Drawing Figures

Figure 1:
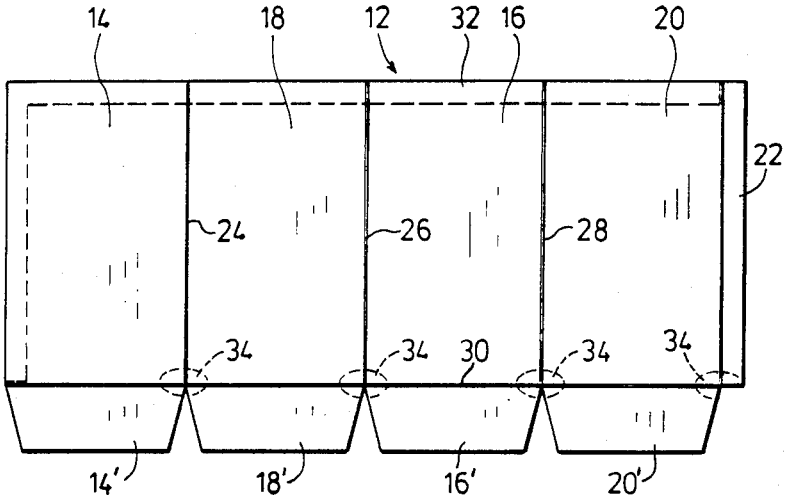

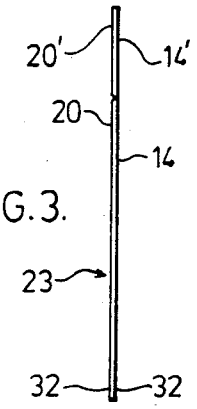
FIG. 3.
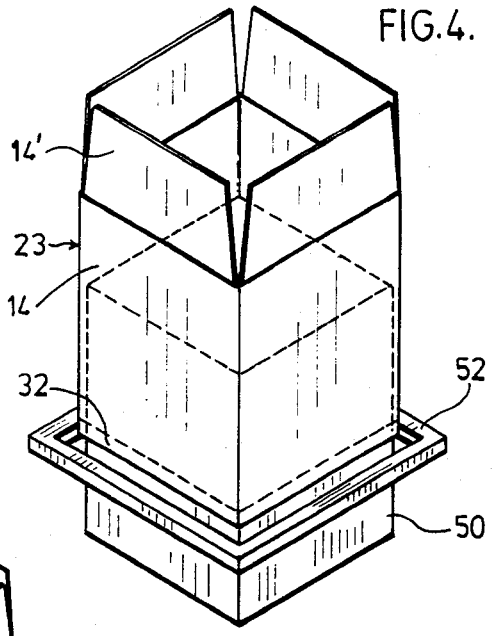
FIG. 4.
FIG. 5.
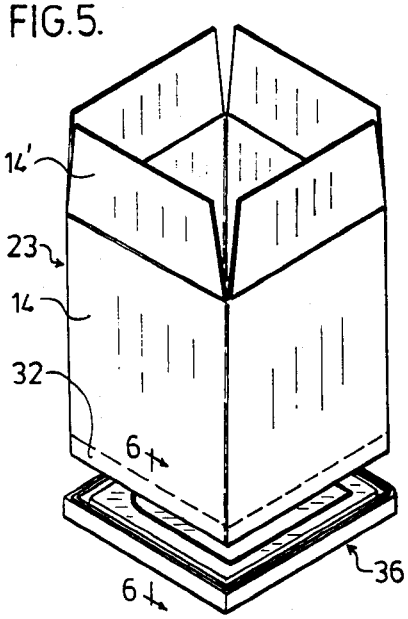
FIG. 6.
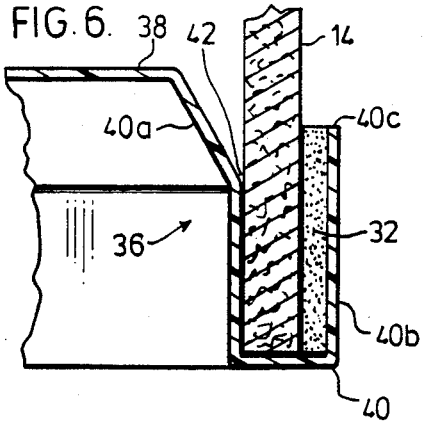
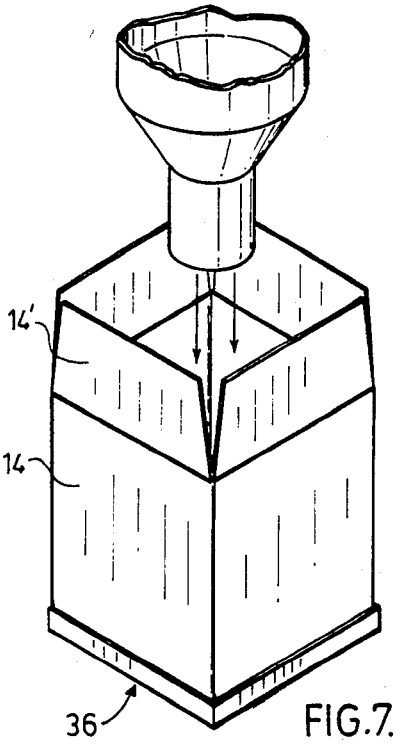
FIG. 7.

METHOD OF FORMING, FILLING AND HERMETICALLY SEALING CONTAINERS

This is a continuation-in-part of U.S. patent application Ser. No. 385,430 filed June 7, 1982, now abandoned.

This invention relates to forming, filling and hermetically sealing containers which, because of the nature of the products contained therein, have to be hermetically sealed and also have to be reclosable after opening. Such containers are primarily used for food products.

In the food industry, it is necessary to hygienically package foods in containers which adequately protect the contents during the whole time from filling the container to purchase and use by the consumer. Furthermore, with many foods, it is desirable for the container to be reclosable by the consumer after an initial opening. At the same time, to keep down the cost of the product concerned, it is necessary for the container and the filling and sealing procedure to be as inexpensive as possible. Many attempts have of course been made to provide containers and filling and sealing operations which meet such criteria, but suitable containers and/or filling and sealing operations are still undesirably expensive.

It is therefore an object of the invention to provide a reclosable hermetically sealable container and a method of filling and sealing such a container which adequately protects the contents and yet at the same time is relatively inexpensive.

According to the invention, a method of forming, filling and hermetically sealing a container comprises providing a container of paperboard material with opposed encs, said container body being of rectantular section with a front panel, a rear panel and two side panels, said panels having level edges at one end with a strip of thermoplastic material extending around surfaces of the panels adjacent the edges, each panel having a closure flap at its opposite end, a dab of thermoplastic material being provided at said opposite end of the junction of each pair of adjacent panels, providing a rectangular closure member of thermoplastic material with a reversely bent peripheral wall providing a groove, said closure member also having an opening and removable closing means closing said opening, the method comprising supplying the container body in a flattened form to a forming station with said opposite end uppermost and said one end lowermost, opening the flattened container body to a box form, heat softening the thermoplastic strip adjacent the edges of the panels at said one end, moving the container body with said one end lowermost to a closure-receiving station, fitting the closure member onto the container body by causing portions of the panels at said one lowermost end to enter into the peripheral groove with the softened thermoplastic strip engaging the peripheral wall of the closure member, allowing the thermoplastic strip to cool and permanently secure the closure member to the container body, thereby forming a container, moving the container to a filling station, filling the container with product while the container is still in the orientation with said opposite end uppermost, moving the filled container to a closing station, closing the container while in said orientation by folding two opposed panels downwardly to a closed position, providing heat softened thermoplastic on the uppermost faces of the closed flaps, folding the other two opposed flaps downwardly to a closed position in engagement with the thermoplastic material on the flaps to cool and thereby seal said opposite end of the container, and heat softening the dabs of thermoplastic material at said junctions of the panels and inverting the container to position said opposite end lowermost to cause said dabs to flow into and seal the corners of the container at said opposite end.

Advantageously, the strip of thermoplastic material extends around the outer surfaces of the panels adjacent the top edges.

The method of forming, filling and hermetically sealing a container in accordance with the invention is relatively inexpensive and also hygienic and is particularly useful in a mechanized operation in which various work stations of the method may be in-line or in a rotary path.

Figure 2:
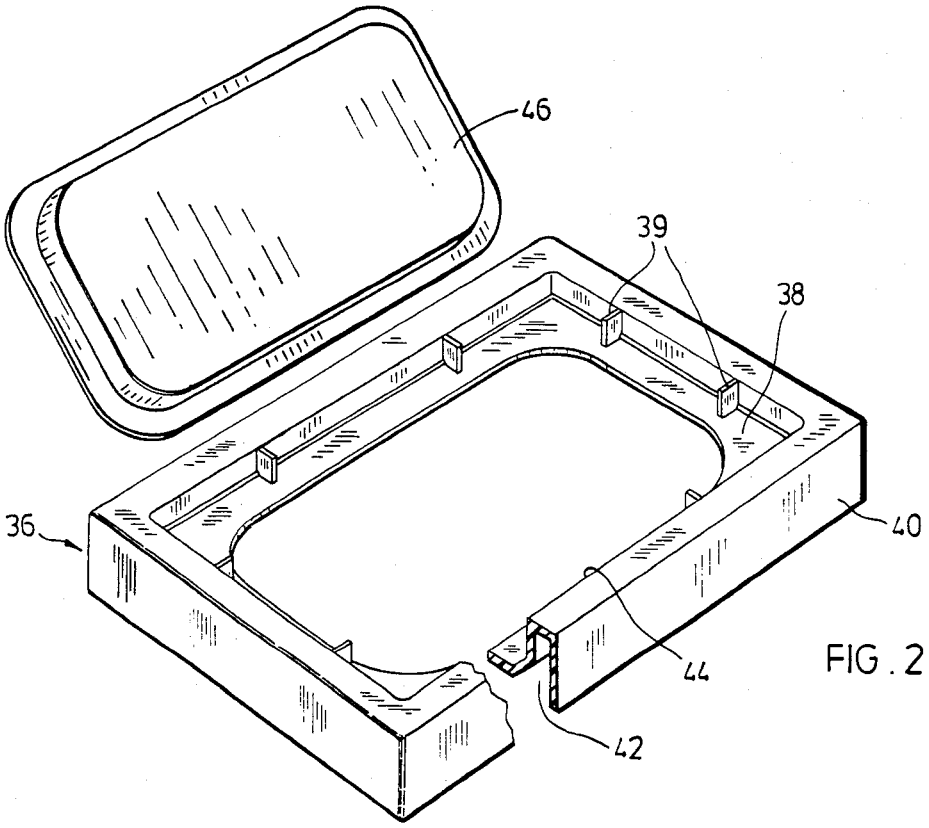
Figure 8:
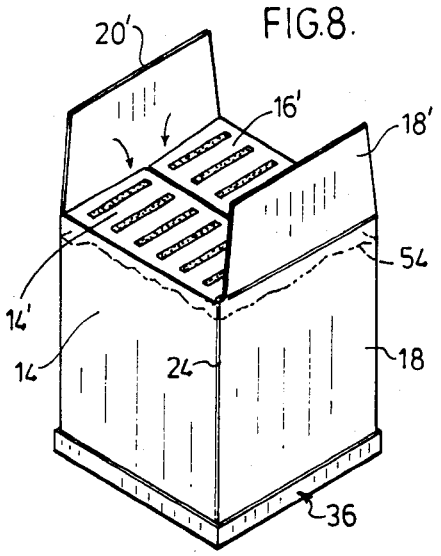
Figure 9:
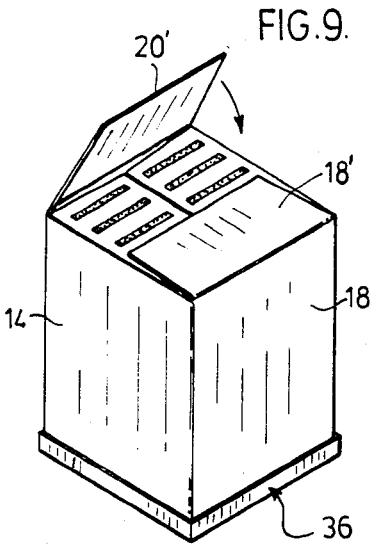
Figure 10:
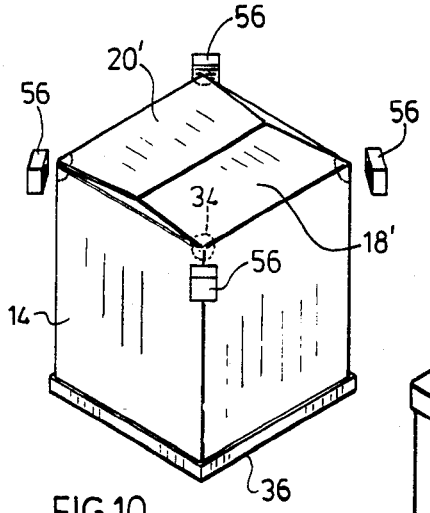
Figure 11:
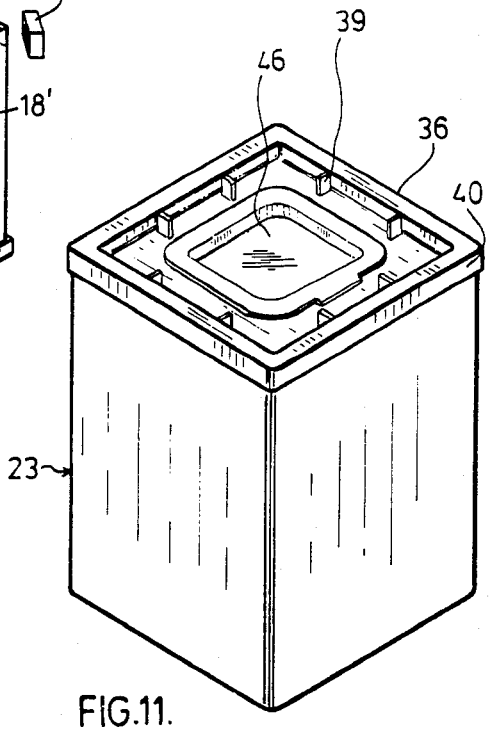

One embodiment of the invention will now be described, by way of example, with reference to the accompanying drawings, of which:

FIG. 1 is a plan view of a paperboard blank for a container body,

FIG. 2 is a perspective view of a container top, with a corner thereof broken away to show the peripheral groove, FIG. 3 is a side view of the container body in collapsed form, FIG. 4 is a front view of the container body after shaping to box form by a mandrel, and with heat being applied to the thermoplastic strip on the container body, FIG. 5 is a similar view showing the top about to be fitted to the container body, FIG. 6 is a sectional view along the line 6—6 of FIG. 5 after the top has been fitted to the container body, FIG. 7 is a front view showing the container being filled, FIG. 8 is a plan view showing two of the closure flaps folded to the closed position, with hot thermoplastic material applied to the folded flaps, FIG. 9 is a similar view showing the other two bottom flaps being folded into contact with the previously folded flaps, FIG. 10 is a similar view showing heat being applied to the bottom corners, and FIG. 11 is a perspective view of the filled and hermetically sealed container.

Referring to the drawings, FIG. 1 shows a preformed blank 12 for a rectangular container body, the blank having a front panel 14, a rear panel 16, and side panels 18, 20. The container blank 12 is made of paperboard which has been printed with the required product information and die-cut from a sheet of paperboard material. The upper edges of the panels are level, and the bottom end of each panel has a closure flap 14', 18', 16' and 20' respectively. The side edge of the side panel 20 has an edge flap 22 which is securable by suitable adhesive to the inside of an edge portion of the front panel 14 in known manner to form a container body 23, see FIGS. 3–11, with fold lines 24, 26, 28 and 30 being provided to facilitate formation of the container body 23 from the blank 12.

In accordance with the invention, the outer face of the blank 12 is provided along its upper edge portion with a strip 32 of thermoplastic material, such as polypropylene, which extends across the top end portions of the panels 14, 18, 16, 20 so as to extend completely around the container body 23. Also, the inner face of the blank 12 is provided at the bottom end of each fold line 24, 26, 28 and at the bottom of the side panel 20 adjacent the edge flap 22 with a dab 34 of thermoplastic material, such as polypropylene.

FIG. 2 shows a rectangular container top 36 of injection molded thermoplastic material, such as polypropylene. The top 36 has a rectangular generally flat main portion 38 with a reversely bent peripheral wall 40 forming a downwardly extending peripheral groove 42. The central part of the main portion 38 has a generally rectangular opening 44 with rounded corners and a lid 46 shaped for snapping airtight engagement with the edge of the opening 44.

The container body 23 will usually be supplied to a container forming, filling and sealing operation in a flattened form and in an upside down orientation, as shown in FIG. 3. The sequence of operations now to be described can be carried out in an in-line manner or in a rotary manner, as will be clearly apparent to a person skilled in the art.

The upside down container body 23 first passes to a forming station (FIG. 4) where a mandrel 50 is moved upwardly into the container body 23 to open it out from flattened to box form. Also, the thermoplastic strip 32 is heated to a softened state by radiant heaters 52 placed around the container body 23.

The container body 23 is then immediately moved to a closure-receiving station (FIG. 5) where a container top 36, also in upside down orientation and with lid 46 closed, is fitted onto the now lower end of the container body 23. The sectional view shown in FIG. 6 illustrates the relative dimensions of the front panel 14 of the container body 23 and the reversely bent wall 40 and peripheral groove 42 of the top 36, with the sectional view shown in FIG. 6 also of course applying to the other panels of the container body 23. The reversely bent peripheral wall 40 has an initial inclined guiding portion **40*a* extending from the main portion 38 of the top 36, this guiding portion 40*a* functioning to guide the lower end of the container front panel 40 into the groove 42. The outer portion 40*b* of the wall 40 has a length just slightly greater than the depth of the thermoplastic strip 32 on the panel 14, and the outer wall portion 40*b* has a free end edge 40*c* which terminates at a level laterally aligned with approximately the midpart of the inclined guiding portion 40*a***.

When the top 36 is being fitted onto the lower end of the container body 23 therefore, the lower end portions of the panels, 14, 16, 18, 20 with the softened thermoplastic strip 32 are guided into the peripheral groove 42 in the top 36 by the inclined guiding wall portion **40*a*. The fitting movement is continued until the lower end portion 40*b* is such that the softened thermoplastic strip 32 substantially fills the clearance space as shown in FIG. 6. The thermoplastic strip 32 is then allowed to cool and by bonding to the outer wall portion 40*b* permanently secures the top 36 to the container body 23**, thereby forming a container.

The application of the top 36 to the container body 23, while the container body 23 is in an upside down orientation, enhances the hermetic seal between these two components since the heat softened thermoplastic material on the lower end of the container body 23 tends to flow downwardly into the top 36.

The container in its upside down orientation is then passed to a filling station (FIG. 7) where the contents 54 are supplied downwardly into the container. Such contents may for example be spoonable, or shakable, it being understood that the actual design of the reclosable lid 46 will depend on the nature of the product in the container. The lid 46 shown is intended for use with granular and powdered products. The container is then in the condition shown in FIG. 7, that is to say filled and upside down, with the closure flaps 14', 16', 18', 20' still in the open position. The filling of the container while in the upside down configuration means that the container does not have to be reoriented for this purpose.

The filled container then passes to a first closing station (FIG. 8) where the closure flaps 18', 20' are bent downwardly into the closed position and heat-softened thermoplastic material is applied to the upper surfaces. A partially closed container is then immediately passed to a second closing station (FIG. 9) where the other closure flaps 14', 16' are bend downwardly into the closed position in engagement with the softened thermoplastic material on the flaps 18', 20'. This thermoplastic material (which again may be polypropylene) is then allowed to cool, thus permanently securing the end flaps in the closed position.

Finally, the closed container passes to a final closing station (FIG. 10) where radiant heaters 56 are positioned to heat and thereby soften the dabs 34 of thermoplastic material. The container is then turned to an upright position so that this thermoplastic material runs into the interior corners formed by the panels and the closure flaps to more thoroughly seal the container and, prevent a leakage of product from the corners. The hermetically sealed container is then as shown in FIG. 1.

The strip 32 of thermoplastic material may additionally or alternatively extend around the inner surfaces of the panels 14, 16, 18, 20 adjacent their top edges for permanent bonding with an inner portion of the peripheral wall 40 of the top 36. Further, the top 36 may have stacking webs 39 on the interior of the peripheral wall 40 to enable the tops 36 to be stacked one upon the other before supply to the top-receiving station shown in FIG. 5. Also, the blank 12 may be provided with a barrier material on the future inner faces of the container if the nature of the product requires.

The advantages of the invention will be readily apparent from the foregoing dewcription of the preferred embodiment. Other embodiments will be readily apparent to a person skilled in the art, the scope of the invention being defined in the appended claims.

What I claim as new and desire to protect by Letters Patent of the United States is:

1. A method of forming, filling and hermetically sealing a container, comprising providing a container body of paperboard material with opposed ends, said container body being of rectangular section with a front panel, a rear panel and two side panels, said panels having level edges at one end with a strip of thermoplastic material extending around surfaces of the panels adjacent the edges, each panel having a closure flap at its opposite end, a dab of thermoplastic material being provided at said opposite end of the junction of each pair of adjacent panels, providing a rectangular closure member of thermoplastic material with a reversely bent peripheral wall providing a groove, said closure member also having an opening and removable closing means closing said opening, the method further comprising supplying the container body in a flattened form to a forming station with said opposite end uppermost and said one end lowermost, opening the flattened container body to a box form, heat softening the thermoplastic strip adjacent the edges of the panels at said one end, moving the container body with said one end lowermost to a closure-receiving station, fitting the closure member onto the container body by inverting the closure member and causing portions of the panels at said one lowermost, end to enter into the peripheral groove of the inverted closure member with the softened thermoplastic strip engaging the peripheral wall of the closure member, thus enchancing the hermetic seal between the closure member and the container body since the heat softened thermoplastic strip tends to flow downwardly into the closure member allowing the thermoplastic strip to cool and permanently secure the closure member to the container body, thereby forming a container, moving the container to a filling station, filling the container with product while the container is still in the orientation with said opposite end uppermost, moving the filled container to a closing station, closing the container while in said orientation by folding two opposed panels downwardly to a closed position, providing heat softened thermoplastic on the uppermost faces of the closed flaps, folding the other two opposed flaps downwardly to a closed position in engagement with the thermoplastic material on the flaps and allowing the thermoplastic material to cool and thereby seal said opposite end of the container, and then heat softening the dabs of thermoplastic material at said junctions of the panels and inverting the container to position said opposite end lowermost to cause said dabs to flow into and seal the corners of the container at said opposite end to more thoroughly seal the container and prevent possible leakage of the product from the corners of the corner.

2. A method according to clarm 1 wherein the strip of thermoplastic material extends around the outer surfaces of the panels of said container body at said one end.

* * * * *